United States Patent [19]

Sanders

[11] Patent Number: 4,913,293

[45] Date of Patent: Apr. 3, 1990

[54] CONTAINER OF FLEXIBLE MATERIAL

[76] Inventor: Bernard Sanders, Mont Clos, Old Beaumont Hill, St. Peter, Jersey, Channel Islands, Channel Islands

[21] Appl. No.: 271,280

[22] Filed: Nov. 15, 1988

[30] Foreign Application Priority Data

Nov. 20, 1987 [GB] United Kingdom ..... 8727196

[51] Int. Cl.[4] ..... B65D 33/16

[52] U.S. Cl. ..... 206/620; 383/58; 383/66; 383/87

[58] Field of Search ..... 383/44, 58, 87, 66, 383/63; 206/610, 620, 632

[56] References Cited

U.S. PATENT DOCUMENTS

| | | | |
|---|---|---|---|
| 2,780,262 | 2/1957 | Lennartz | 383/87 |
| 3,051,209 | 8/1962 | Gonzalez | 383/58 |
| 3,272,424 | 9/1966 | Rodkey | 206/632 |
| 3,397,835 | 8/1968 | Henning | 206/610 |
| 3,534,901 | 10/1970 | Repko et al. | 206/620 |
| 3,570,751 | 3/1971 | Trewella . | |
| 3,674,195 | 7/1972 | Stone | 206/632 |
| 3,687,358 | 8/1972 | Wink et al. | 206/632 |
| 4,709,399 | 11/1987 | Sanders . | |

FOREIGN PATENT DOCUMENTS 8610785.2 12/1987 Fed. Rep. of Germany .

*Primary Examiner*—Stephen P. Garbe

*Attorney, Agent, or Firm*—Hoffman, Wasson, Fallow & Gitler

[57] ABSTRACT

A container (10) of flexible material comprises a wall (16) having a row of serrations (18) therein extending diagonally of a corner thereof and an internal sheet (19) which is adhesively secured to an inner surface of the wall (16) by peelable pressure sensitive adhesive (20) and by upper and lower seals (13,14) to provide the container (10) with a tamper evident airtight closure.

4 Claims, 6 Drawing Sheets

CONTAINER OF FLEXIBLE MATERIAL

Figure 1:
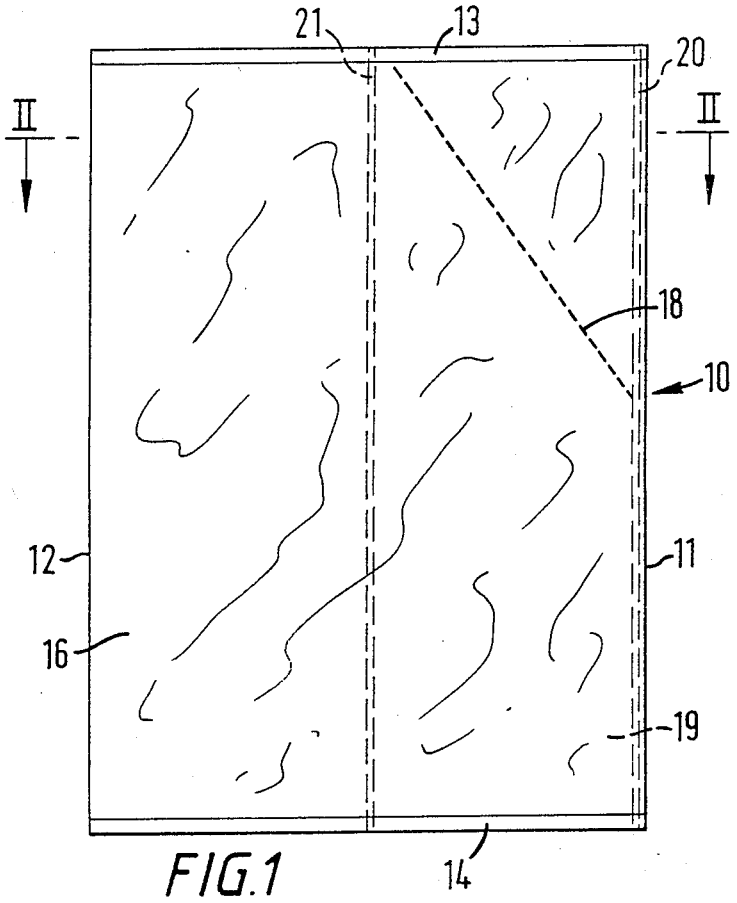

This invention relates to a container of flexible material, a method of manufacturing such a container and a component of flexible material for manufacturing containers in accordance with the method.

In the packaging industry, packaging of products by a seamed tube method is well known. The seamed tube packaging method comprises moving a web of flexible heat sealable film material in a longitudinal direction of the web relative to a tubular former of a packaging machine. The web is guided by the former so that longitudinal marginal edge portions of the web overlap one another and are heat sealed one to another to form a back seal extending in a longitudinal direction of the former. The web is thus progressively formed into a tube which is advanced incrementally by drive belts located external to the tube or by sealing jaws. The jaws provide the tube of film material, whether advanced by drive belts or by the jaws, with a transverse heat seal while simultaneously severing the material of the tube longitudinally of the seal. Articles to be packaged are inserted into the former and pass into the tube of film material. Timing is controlled so that each article or batch of articles is synchronised to enter the tube after provision of a transverse heat seal and subsequent incremental movement of the tube but prior to provision of a successive transverse heat seal. Since the tube of film material is severed in each transverse seal, the arrangement is such that there is formed by the provision of two successive transverse seals a flexible container containing an article or a predetermined batch of articles. Each container thus comprises an upper transverse seal, a lower transverse seal and a back seal extending longitudinally from the upper transverse seal to the lower transverse seal.

Although such containers generally are satisfactory with regard to protection of articles contained therein, a disadvantage of such containers is that they are difficult to open without use of an additional tool, such as a knife or a pair of scissors.

Another disadvantage of such containers is that, generally, once opened they are not satisfactorily reclosable, the contents being subject to accidental spillage.

In German Gebrauchsmuster No. 8610785.2 there is disclosed a machine for manufacturing containers of flexible material according to the seamed tube method. Each container comprises an upper transverse seal, a lower transverse seal and a back seal extending longitudinally from the upper transverse seal to the lower transverse seal. Each container also comprises a panel provided with a row of serrations extending substantially parallel to the back seal. Furthermore, the panel has applied to an inner surface thereof behind the row of serrations an internal sheet of flexible material.

Opening of the container is easily effected by severing the material of the container longitudinally of the row of serrations thereby providing an opening in the panel. Therefore, the container does not require use of an additional tool to effect opening thereof. Furthermore, the container, once opened, is reclosable because the internal sheet, having been manipulated to open the container, returns to a condition adjacent the inner surface of the panel such that the internal sheet covers the opening.

However, a disadvantage of containers manufactured by means of the machine disclosed in German Gebrauchsmuster No. 8610785.2 is that the upper and lower transverse seals of each container as it is dispensed from the machine are, in effect, spaced parallel side seals when the container is in use, the container being held prior to opening such that the row of serrations extends horizontally. The public has become accustomed to containers of flexible material manufactured by the seamed tube method having spaced parallel marginal end seals at the top and bottom of a container instead of at opposite sides thereof. Therefore, there is consumer resistance to the type of container manufactured according to German Gebrauchsmuster No. 8610785.2.

Accordingly, the invention is characterized in that a container of flexible material formed by the seamed tube method is provided with an opening location which extends in non-parallel relationship with a back seal of the container.

This is achieved according to the invention in a method which includes a step of providing a web of flexible material with a series of opening locations spaced one from another in a longitudinal direction of the web and each opening location extending in non-parallel relationship with a longitudinal axis of the web.

The method may be effected by incorporating with the web a component comprising a sheet of flexible material provided with adhesive extending along a margin thereof for uniting the sheet and the web.

The invention therefore provides a container of flexible material formed by the seamed tube method in which spaced parallel marginal end seals are at the top and bottom of the container.

However, the invention also provides a container of flexible material formed by the seamed tube method wherein an opening location is provided such that, when the container is opened, a portion adjacent the opening location is manipulated into a configuration whereby contents of the container easily may be poured therefrom.

The term 'opening location' may comprise a series of tear perforations or slits or a continuous slit or slot or line of weakening or cuts or a series of saw-tooth configurations.

Following is a description, by way of example only and with reference to the accompanying drawings, of one method of carrying the invention into effect.

Figure 2:
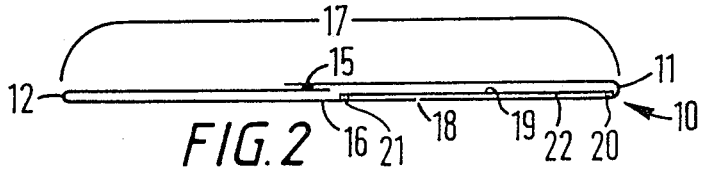
Figure 3:
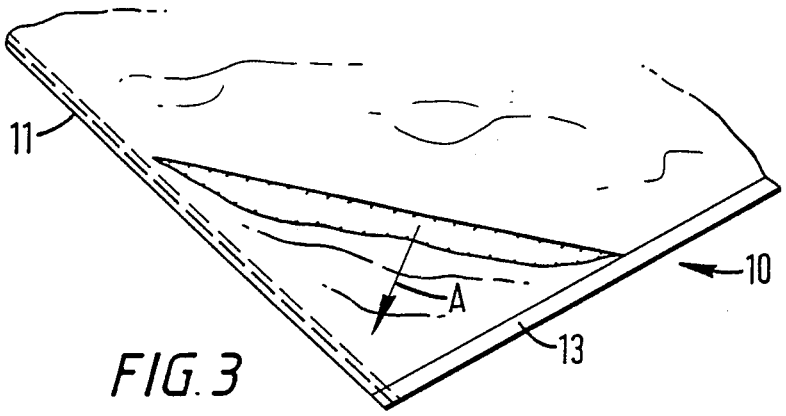
Figure 4:
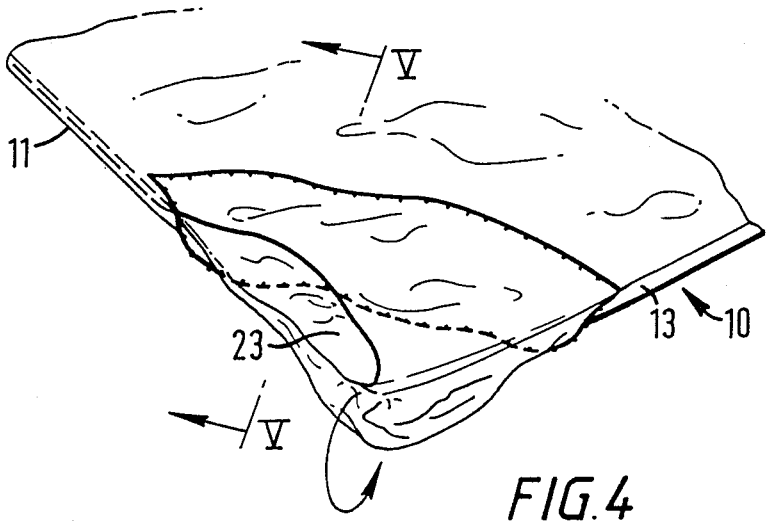
Figure 5:
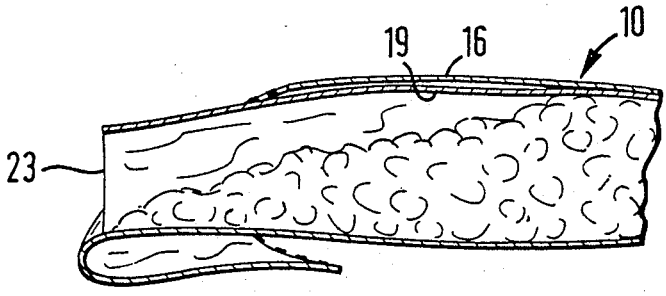
Figure 7:
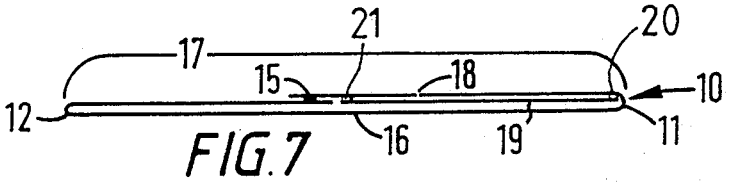
Figure 8:
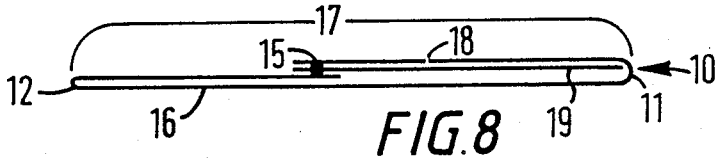
Figure 9:
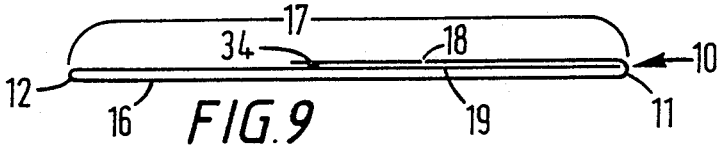
Figure 10:
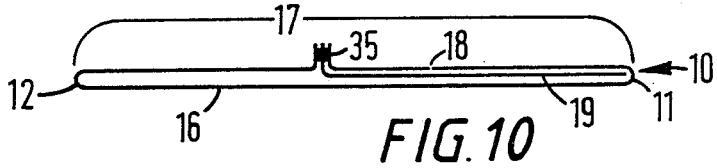
Figure 6:
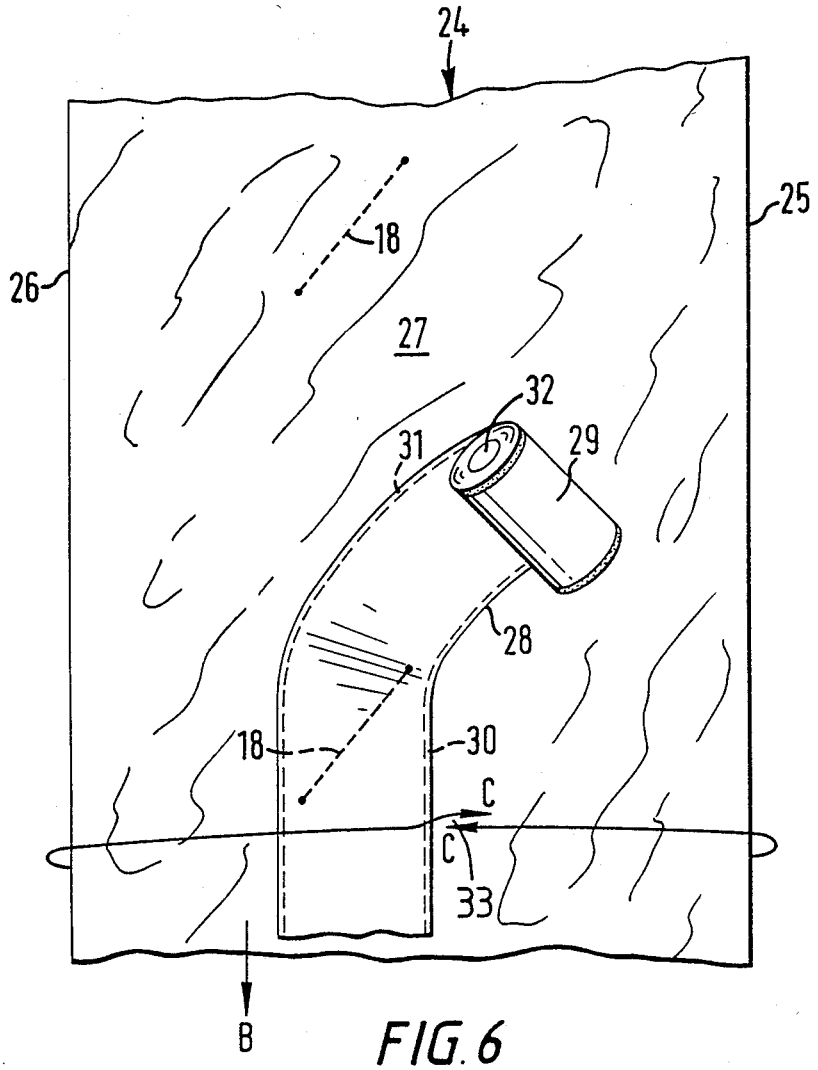
Figure 11:
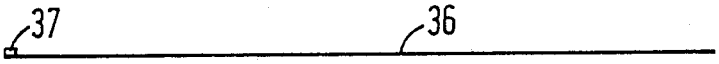
Figure 12:
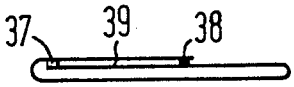
Figure 14:
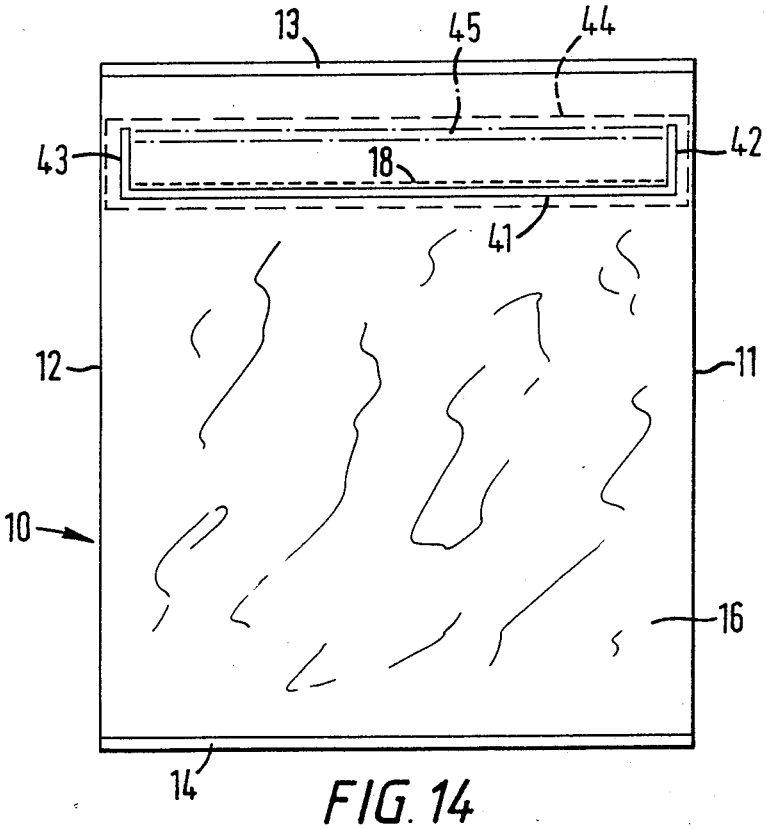
Figure 13:
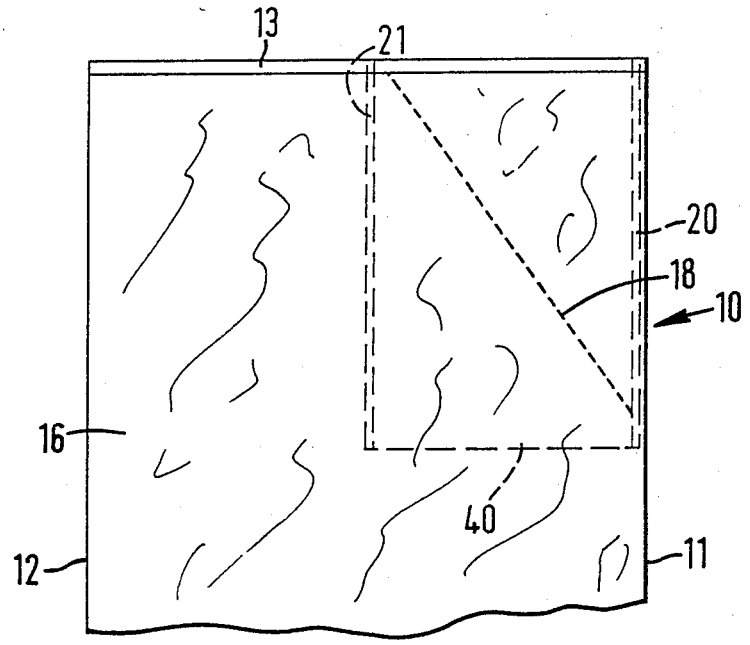
Figure 15:
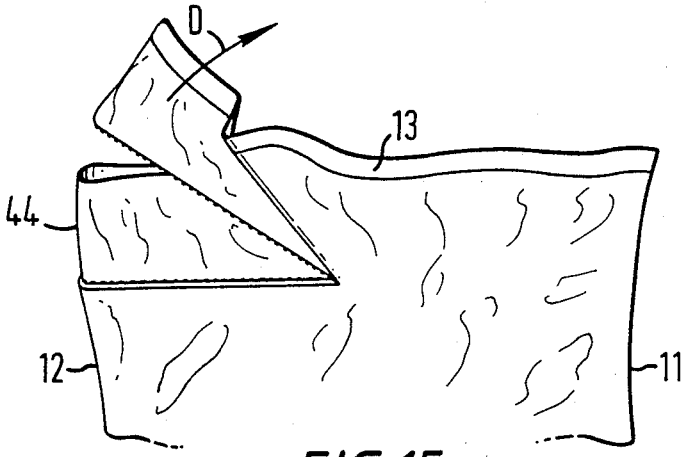

In the drawings:

FIG. 1 is an elevation of one embodiment of a container in accordance with the present invention, FIG. 2 is a cross section on the line II—II of FIG. 1, FIG. 3 is a diagrammatic representation indicating an initial stage during opening of the container shown in FIGS. 1 and 2, FIG. 4 is a diagrammatic representation, similar to FIG. 3, of the container shown in FIGS. 1 and 2 when in an open condition, FIG. 5 is a cross section on the line V—V of FIG. 4, FIG. 6 is a diagrammatic representation of a stage during manufacture of containers in accordance with the embodiment shown in FIGS. 1 to 5, FIG. 7 is a view, similar to FIG. 2, of another embodiment of a container in accordance with the present invention, FIG. 8 is a view similar to FIGS. 2 and 7 of a further embodiment of a container in accordance with the present invention, FIG. 9 is a view similar to FIGS. 2,7 and 8 of another embodiment of a container in accordance with the present invention, FIG. 10 is a view similar to FIGS. 2,7,8 and 9 of another embodiment of a container in accordance with the present invention, FIG. 11 is a cross section of a web of flexible material adapted for manufacturing another embodiment of a container in accordance with the present invention, FIG. 12 is a cross section of a container manufactured from the web shown in FIG. 11, FIG. 13 is a view similar to FIG. 1 of another embodiment of a container in accordance with the present invention, FIG. 14 is a view, similar to FIG. 1, of another embodiment of a container in accordance with the present invention, and FIG. 15 is a diagrammatic perspective view of another embodiment of a container in accordance with the present invention.

Referring now to FIGS. 1 to 5 inclusive of the drawings, there is shown a container 10 formed of plastics film material which is folded to form two spaced substantially parallel side folds 11,12 and opposite facing surfaces being united one with another in upper and lower seals 13,14 extending in spaced parallel relation one to another and transverse to the side folds 11,12 and overlapping longitudinal marginal surfaces being united one with another in a back seal 15 extending substantially parallel to and substantially midway between the side folds 11,12 and extending from the upper to the lower of the transverse seals 13,14. The configuration provides a front panel 16 and a rear panel 17.

Prior to folding, the material is provided with a row 18 of serrations and has united therewith an elongate sheet 19 of film material having longitudinal strips of peelable pressure sensitive contact adhesive 20,21 on a surface 22 thereof and located adjacent opposite facing margins of the sheet 19, the sheet 19 being united with the material by means of the adhesive. The sheet 19 is located such that, on formation of the side folds 11,12 the upper and lower seals 13,14 and the back seal 15, the sheet 19 is contained within the formation such as to extend longitudinally of and between the front and rear panels 16,17, the longitudinal dimension of the sheet 19 being such that upper and lower portions of the sheet 19 are sealed in the respective upper and lower seals 13,14 and the transverse dimension of the sheet 19 being such that the sheet 19 is located between the back seal 15 and the side fold 11.

The row of serrations 18 extends downwardly from an upper position adjacent the upper seal 13 at a location adjacent the adhesive strip 21 to a lower position adjacent but spaced inwardly from the side fold 11.

The container 10 is opened by fracturing the material of the front panel 16 along the row of serrations 18 and by reversing an upper corner of the front panel 16 above the row of serrations 18, as indicated by the arrow A in FIG. 3, thereby providing a corner opening 23, as shown in FIGS. 4 and 5, whereby contents of the container easily may be poured therefrom.

Re-closure of the container 10 is effected by returning the folded upper corner of the front panel 16 to the position shown in FIG. 1.

Referring now to FIG. 6, containers 10 are manufactured by the seamed tube method from a web 24 of film material having spaced parallel longitudinal margins 25,26 and an upper surface 27. The web is provided with rows of serrations 18 at intervals in a longitudinal direction of movement of the web 24, as idicated by the arrow B in FIG. 6, the rows of serrations 18 being parallel one to another and each row being spaced an equal distance from an adacent row and each extending in the plane of the surface 27 diagonally of a common longitudinal axis of the web 24 and the rows being grouped in a single column extending parallel to and adjacent a central longitudinal axis of the web 24.

The web 24 has united therewith an additional web 28 of film material portions of which are to form the internal sheet 19 of each container 10, the web 28 having a lower surface 29 on opposite facing margins of which is coated throughout the whole length of the web 28 strips of peelable pressure sensitive adhesive 30,31 portions of which will comprise the strips 20,21 of each container 10. The additional web 28 is wound on a reel 32.

The arrangement is such that the lower surface 29 of the additional web 28 is united with the upper surface 27 of the lower web 24 by means of the adhesive strips 30,31 and, as the lower web 24 advances through a packaging machine, the additional web 28 is guided onto the upper surface 27 progressively unwinding the reel 32 and applying the additional web 28 on the wider web 24 so as to cover the column of rows of serrations 18.

Subsequently, during the seamed tube method, the longitudinal margins 25, 26 of the web 24 are turned inwardly towards one another as indicted by the arrows C—C in FIG. 6, such that the longitudinal margin 26 overlaps the longitudinal margin 25 and is united therewith, either by welding or by pressure sensitive adhesive, to form a back seal 33.

The web 24, combined with the web 28, thus forms a tube and opposite facing surfaces of the tubular configuration are crimped and/or welded one to another in a transverse seal (not shown). Simultaneously with providing a transverse seal, the seal is severed i a longitudinal direction thereof. Contents are inserted in the tubular configuration, the tubular configuration is advanced longitudinally and the process is repeated thereby providing a container 10 containing contents and having upper and lower transverse seals 13,14, a front panel 16, a rear panel 17 and an internal sheet 19 united with an inner surface of the front panel 16 by means of parallel strips of adhesive 20,21.

It will be appreciated that the provision of the strips of adhesive 20,21 ensures that the web 28 is united with the web 24 during movement of the web 24 through a packaging machine.

It will also be appreciated that the internal sheet 19, may be attached to the rear panel 17 instead of the front panel 16, as shown in FIG. 7, and a longitudinal marginal edge of the internal sheet 19 may be located in the back seal 15, as shown in FIG. 8.

It will also be appreciated that the internal sheet 19 need not comprise a separate portion of film material but may be formed from a single web of plastics film material which is folded and welded so as to include the internal sheet 19 a longitudinal marginal portion of which is included in a back seal in the form of a lap seal 34 (see FIG. 9) or a fin seal 35 (see FIG. 10).

In each of the embodiments shown in FIGS. 8 to 10, the internal sheet 19 does not carry either of the strips of adhesive 20,21. However, in each of the embodiments the container 10 would not be airtight. In order to provide an airtight container 10 it would be necessary to provide at least the marginal strip 20 of peelable adhesive.

With regard to the embodiment shown in FIG. 9, if it is necessary to provide airtight containers 10 such containers may be formed by the seamed tube method from a web 36 (see FIG. 11) having a strip 37 of peelable pressure sensitive contact adhesive extending along a margin thereof. When the web 36 is subsequently formed into a tube and provided with a back seal 38 (see FIG. 12), the tube will comprise an internal sheet 39 having a strip 37 of peelable adhesive.

It will be appreciated that the internal sheet 19 need not extend longitudinally of a container 10 from the upper seal 13 to the lower seal 14 but may comprise a smaller area located in an upper corner of the container, as shown at 40 in FIG. 13.

Furthermore, it will be appreciated that the row of serrations 18 may extend substantially parallel to and adjacent the upper seal 13, as shown in FIG. 14. The strips of pressure sensitive adhesive would be in the form of a pattern comprising a rectilinear portion 41 below the row of serrations 18 and a pair of shorter portions 42,43 extending upwardly from opposite ends of the rectilinear portion 41 and inwardly of and substantially parallel to corresponding side folds 11,12 of the container 10. An internal sheet 44 may comprise an elongate rectangular patch extending transversely of the front panel 16 and the adhesive pattern may include a peelable portion 45 extending substantially parallel to the lower portion 41 from one to the other of the shorter portions 42,43.

In the embodiment illustrated in FIG. 15 there is shown an embodiment similar to FIG. 14 except that the location of the row of serrations 18, the internal sheet 44 and the adhesive pattern 41,42,43 extend around the fold 12 thereby providing a 'flip-top' arrangement. A container provided with such a 'flip-top' arrangement is opened by severing the material of the container 10 along the row of serrations 18 and applying a rearward force to an adjacent upper corner of the container 10, as indicated by the arrow D in FIG. 15.

It will be appreciated that each of the embodiments described above comprises a container having a tamper evident closure since, once the material of the container has been severed along a row of serrations 18, it is evident that the container has been opened.

Furthermore, it will be appreciated that each of the embodiments described above comprises a container which is re-closable since, once the container has been returned to a condition prior to opening, the internal sheet returns to a position covering the opening location.

Also, in the embodiments inclusing a peelable seal there is provided a container which is airtight.

I claim:

1. A reclosable container formed from a tube of flexible material having a back seal extending parallel to a longitudinal axis of said tube, said container comprising a wall having an inner surface, an upper transverse seal, a lower transverse seal, an opening location means and an internal member extending the length of the container adjacent said inner surface and adjacent said opening means wherein said opening means extends in a direction oblique to said axis.

2. A container as claimed in claim 1 wherein said internal member and said inner surface of said wall are united one with another in a pattern and said pattern includes a peelable seal.

3. A container as claimed in claim 2 wherein said opening means is located adjacent a corner of said container such as to form a pourer when said wall is manipulated and said container is opened.

4. A container of flexible material comprising an upper transverse seal, a lower transverse seal and a back seal extending longitudinally from the upper transverse seal to the lower transverse seal and an outer wall having an opening means therein and an internal member extending adjacent an inner surface of the wall adjacent the opening means, wherein the opening means extends obliquely with respect to the back seal, the internal member is secured to said inner wall surface, and the internal member and the wall are united with one another in a pattern including a peelable seal.

* * * * *